US010137910B2

(12) United States Patent
Yu et al.

(10) Patent No.: US 10,137,910 B2
(45) Date of Patent: Nov. 27, 2018

(54) RAIL VEHICLE BOGIE DRAW-GEAR

(71) Applicant: CRRC QINGDAO SIFANG CO., LTD., Qingdao, Shandong (CN)

(72) Inventors: Dalian Yu, Shandong (CN); Haitao Li, Shandong (CN); Wenqiang Qu, Shandong (CN); Shaoqing Liu, Shandong (CN); Jun Lin, Shandong (CN); Xiaojun Deng, Shandong (CN); Ming Gong, Shandong (CN); Jianying Liang, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 322 days.

(21) Appl. No.: 15/112,238

(22) PCT Filed: Sep. 22, 2015

(86) PCT No.: PCT/CN2015/090247
§ 371 (c)(1),
(2) Date: Jul. 18, 2016

(87) PCT Pub. No.: WO2016/050150
PCT Pub. Date: Apr. 7, 2016

(65) Prior Publication Data

US 2016/0332642 A1 Nov. 17, 2016

(30) Foreign Application Priority Data

Sep. 30, 2014 (CN) ..... 2014 1 0522234

(51) Int. Cl.
*B61F 5/24* (2006.01)
*B61F 5/16* (2006.01)
*B61F 1/14* (2006.01)

(52) U.S. Cl.
CPC ..... *B61F 5/245* (2013.01); *B61F 1/14* (2013.01); *B61F 5/16* (2013.01)

(58) Field of Classification Search
CPC ..... B61F 1/14; B61F 5/10; B61F 5/16; B61F 5/18; B61F 5/20; B61F 5/24; B61F 5/245
(Continued)

(56) References Cited

U.S. PATENT DOCUMENTS 2,499,087 A * 2/1950 Bourdon ..... B61F 5/16 105/193
3,403,638 A * 10/1968 Hirst ..... B61F 5/148 105/199.1
(Continued)

FOREIGN PATENT DOCUMENTS

AT 268372 B 2/1969
CN 200960931 Y 10/2007
(Continued)

OTHER PUBLICATIONS

International Search Report for PCT/CN2015/090247 , dated Dec. 31, 2015, ISA/CN.

*Primary Examiner* — Zachary L Kuhfuss
(74) *Attorney, Agent, or Firm* — U.S. Fairsky LLP; Yue (Robert) Xu

(57) ABSTRACT

A rail vehicle bogie traction device is provided, which includes a center pin and two traction rubber bag assemblies. Each of the traction rubber bag assemblies includes a traction rubber stack and a rubber bag, the rubber bag is filled with fluid, and a pressure of the rubber bag is settable. The traction rubber stack is connected to the rubber bag. The center pin is fixed on a lower surface of a vehicle body chassis bolster. Each of the two traction rubber bag assemblies has one end connected to the center pin, and another end connected to a cross beam of a rail vehicle frame. The rail vehicle bogie traction device has nonlinear characteris-
(Continued)

tics, which may effectively transmit a longitudinal load, and may also prevent high-frequency vibration of the frame from transmitting to the vehicle chassis bolster and the vehicle body via the traction device.

15 Claims, 2 Drawing Sheets

(58) Field of Classification Search
USPC ..... 105/199.4
See application file for complete search history.

(56) References Cited

U.S. PATENT DOCUMENTS 3,628,465 A * 12/1971 Dobson ..... B61F 5/142 105/164
3,707,926 A * 1/1973 Ellzey ..... B61B 12/02 104/123
3,884,157 A 5/1975 Pelabon
4,294,175 A * 10/1981 Harsy ..... B60G 11/52 105/199.3
4,357,879 A * 11/1982 Mohacsi ..... B61F 5/10 105/182.1
4,638,742 A * 1/1987 Potel ..... B61F 5/16 105/199.3
4,841,874 A * 6/1989 Weigel ..... B61F 5/20 105/199.4
2016/0332642 A1* 11/2016 Yu ..... B61F 1/14

FOREIGN PATENT DOCUMENTS

| | | | |
|---|---|---|---|
| CN | 201347094 | Y | 11/2009 |
| CN | 101966851 | A | 2/2011 |
| CN | 102518734 | A | 6/2012 |
| CN | 102963386 | A | 3/2013 |
| CN | 104276185 | A | 1/2015 |
| CN | 204161386 | U | 2/2015 |
| DE | 1530161 | A1 | 10/1969 |
| JP | 57-90262 | U | 6/1982 |
| JP | 61-14927 | Y2 | 5/1986 |
| JP | 11-310127 | A | 11/1999 |
| WO | 2014/076788 | A1 | 5/2014 |

* cited by examiner

RAIL VEHICLE BOGIE DRAW-GEAR

This application is the national phase of International Application No. PCT/CN2015/090247, titled "RAIL VEHICLE BOGIE DRAW-GEAR", filed on Sep. 22, 2015, which claims the benefit of priority to Chinese Patent Application No. 201410522234.2, titled "RAIL VEHICLE BOGIE TRACTION DEVICE", filed with the Chinese State Intellectual Property Office on Sep. 30, 2014, the entire disclosure of which application is incorporated herein by reference.

FIELD

The present application relates to the technical field of rail vehicle bogies, and particularly to a rail vehicle bogie traction device.

BACKGROUND

In rail vehicles, a traction device is generally used to transmit a longitudinal load between a vehicle body and a bogie. At present, a conventional traction device mainly includes two types of traction devices: a single traction bar type and a Z-shaped double traction bar type. The two types of traction devices are both connected to a center pin and a bogie frame through a traction bar having rubber joints at two ends. The traction bar, as a connecting mechanism between the vehicle body and the bogie, is apt to become a transmission path of harmful vibrations. According to research, the stiffness of the traction bar is closely related to the comfort degree of vibration of the vehicle body. Therefore, some joints employ a structure provided with a gap to achieve a nonlinear stiffness. However, since the gap may be adversely affected by the size of the joints, reliability and stability of the gap, the stiffness property of such structure cannot fully meet the design requirements, and under alternating loads, fatigue damage may occur to the rubber joints at the two ends of the traction bar.

SUMMARY

(1) Issues to be Addressed

An object of the present application is to provide a rail vehicle bogie traction device, for achieving variable traction stiffness properties, isolating transmission of harmful vibrations, and improving the ride comfort.

(2) Technical Solutions

To achieve the above objects, a rail vehicle bogie traction device is provided according to the present application, which includes a center pin and two traction rubber bag assemblies. Each of the traction rubber bag assemblies includes a traction rubber stack and a rubber bag, the rubber bag is filled with fluid, and a pressure of the rubber bag is settable. The traction rubber stack is connected to the rubber bag. The center pin is fixed on a lower surface of a vehicle body chassis bolster. Each of the two traction rubber bag assemblies has one end connected to the center pin, and another end connected to a cross beam of a rail vehicle frame.

Specifically, the two traction rubber bag assemblies are symmetrically arranged with respect to a center of the center pin.

Specifically, the two traction rubber bag assemblies are respectively fixedly connected to a front side and a rear side of the center pin.

Specifically, the traction device further includes a center pin seat sleeved on the center pin, and the two traction rubber bag assemblies are connected to the center pin seat and are arranged in a Z shape.

Specifically, the number of the traction rubber stack is two, the number of the rubber bag is one, and the two traction rubber stacks are respectively connected to two sides of the rubber bag and are coaxially arranged.

Specifically, a compression elastic member is provided in the rubber bag, the compression elastic member has one end fixed to an inner surface, at one side close to the center pin, of the rubber bag, and an axis of the compression elastic member is in the same direction as an axis of each of the traction rubber stacks.

Specifically, the rubber bag is provided with a pressure control system, the pressure control system includes a controller, a fluid source, a sensor, a filling valve and a discharging valve, each of the filling valve and the discharging valve is connected to the rubber bag, the fluid source is connected to the filling valve; the sensor is mounted in the rubber bag for detecting the pressure in the rubber bag; and the controller is electrically connected to the fluid source, the sensor, the filling valve and the discharging valve.

Specifically, a pressure reducing valve is provided between the fluid source and the filling valve.

Specifically, the controller is connected to a main control system of the rail vehicle for receiving traction/brake signals and/or a frame acceleration signal of the rail vehicle.

Specifically, the fluid source is an air supply unit or an oil supply unit.

(3) Advantageous Effects

The rail vehicle bogie traction device according to the present application is formed by connecting the traction rubber stacks with the rubber bag, and has nonlinear stiffness characteristics in a longitudinal direction, thus may effectively transmit a longitudinal load and prevent a high-frequency vibration from transmitting to the vehicle body chassis bolster and the vehicle body via the traction device, thereby achieving variable traction stiffness characteristics, isolating transmission of harmful vibration, and improving the ride comfort.

Figure 1:
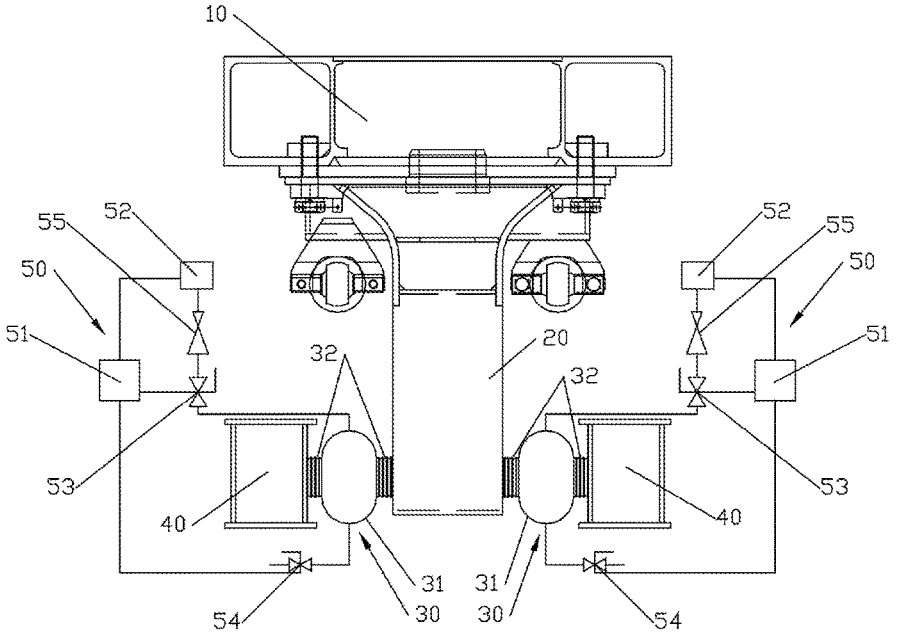
FIG. 1 is a schematic view showing the structure of a rail vehicle bogie traction device according to an embodiment of the present application.

| Reference numerals in FIGS.: | |
|---|---|
| 10 vehicle body chassis bolster, | 20 center pin, |
| 30 traction rubber bag assembly, | 31 rubber bag, |
| 32 traction rubber stack, | 33 compression elastic member, |
| 40 frame, | 50 pressure control system, |
| 51 controller, | 52 fluid source, |
| 53 filling valve, | 54 discharging valve, and |
| 55 pressure reducing valve. | |

DETAILED DESCRIPTION

The embodiments of the present application are further described in conjunction with drawings and examples. The following examples are used to illustrate the present application, and should not be interpreted as a limit to the scope of the present application.

Embodiment 1

Referring to FIG. 1, a rail vehicle bogie traction device according to the present application includes a center pin 20 and two traction rubber bag assemblies 30. Each of the traction rubber bag assemblies 30 includes a traction rubber stack 32 and a rubber bag 31. The body of the rubber bag 31 is made of rubber, and a filling hole is provided in the body. The rubber bag 31 is filled with fluid, and the fluid in the rubber bag 31 is gas or liquid. In this embodiment, the fluid in the rubber bag 31 is compressed air. A pressure of the rubber bag 31 is settable. The traction rubber stack 32 forms a column structure by sequentially stacking multiple rubber sheets. The traction rubber stack 32 and the rubber bag 31 are connected via a flange or glue. When the traction rubber stack 32 is connected to the rubber bag 31, an axial direction of the traction rubber stack 32 is perpendicular to the rubber bag 31, that is, an extension line of an axis of the traction rubber stack 32 passes through the rubber bag 31. In this embodiment, the number of the traction rubber stack 32 is two, the number of the rubber bag 31 is one, and the two traction rubber stacks 32 are respectively connected to two sides of the rubber bag 31 and are coaxially arranged. The center pin 20 is fixed on a lower surface of a vehicle body chassis bolster 10 of a rail vehicle. Each of the two traction rubber bag assemblies 30 has one end connected to the center pin 20 and another end connected to a cross beam of a frame 40 of the rail vehicle. As shown, after mounting, the traction rubber stacks 32 are arranged on two sides of each of the two traction rubber bag assemblies 30. Each of the traction rubber stacks 32 is connected to the rubber bag 31 and the frame 40, and the two traction rubber bag assemblies 30 are located in the same horizontal plane.

The two traction rubber bag assemblies 30 are symmetrically arranged with respect to a center line of the center pin 20. In this embodiment, as shown in FIG. 1, a left side in the figure is referred to as a front side (a forward direction of the rail vehicle), and a right side in the figure is referred to as a rear side. One end of one of the two traction rubber bag assemblies 30 is fixedly connected to a front side of the center pin, and one end of the other one of the two traction rubber bag assemblies 30 is fixedly connected to a rear side of the center pin, which allows the two traction rubber bag assemblies 30 to be located in the same horizontal plane.

Figure 2:
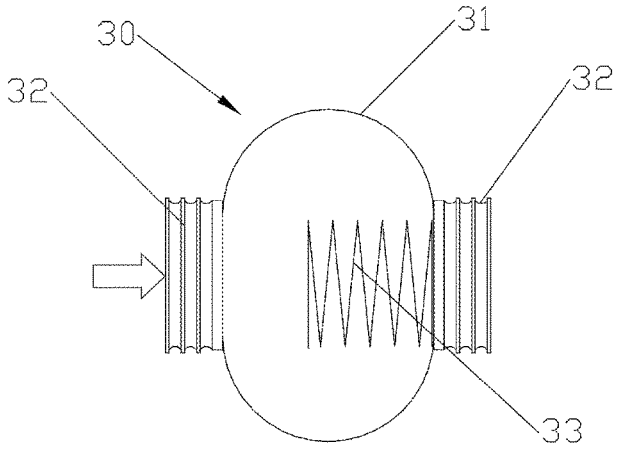
FIG. 2 is a sectional view of a traction rubber bag assembly in an uncompressed state of the rail vehicle bogie traction device according to the embodiment of the present application.
Figure 3:
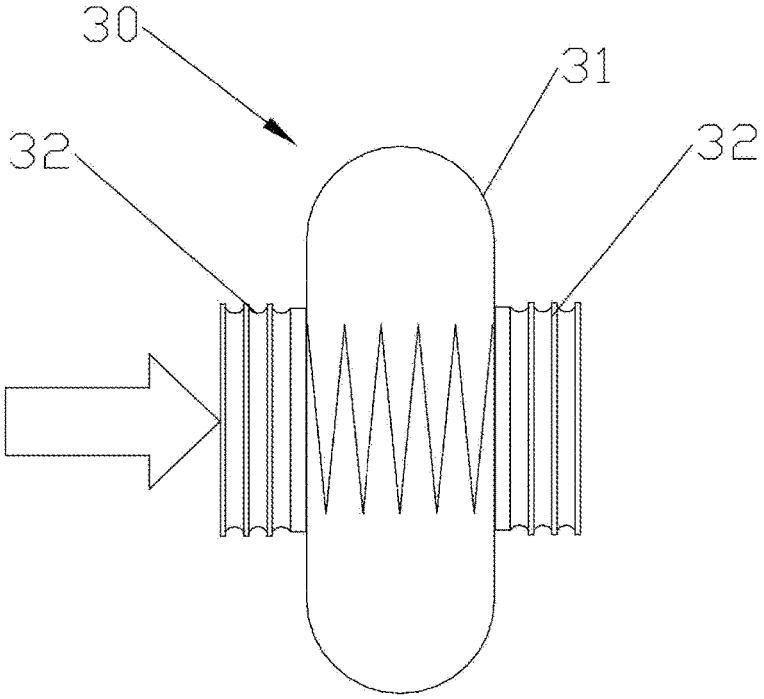
FIG. 3 is a sectional view of the traction rubber bag assembly in a compressed state of the rail vehicle bogie traction device according to the embodiment of the present application.

Further, a compression elastic member 33 is provided in the rubber bag 31. One end of the compression elastic member 33 is fixed to an inner surface, at one side close to the center pin, of the rubber bag 31, and an axis of the compression elastic member 33 extends in the same direction as an axis of the traction rubber stack 32. When the rubber bag 31 is further compressed, the compression elastic member 33 can be compressed. As shown in FIG. 2, the compression elastic member 33 has one end fixed to an inner surface, corresponding to one of the traction rubber stacks 32, of the rubber bag 31, and another end which is a free end. In operation, as shown in FIG. 3, in the case that the traction rubber bag assembly is subjected to a traction force or a break pressure, the rubber bag 31 is compressed by the traction rubber stacks 32 located at two sides of the rubber bag 31. When the rubber bag 31 is compressed to a certain degree, the compression elastic member 33 is compressed. In this embodiment, the compression elastic member 33 is a compression spring. For preventing the compression elastic member 33 from piercing the rubber bag 31, the compression elastic member 33 may be a compression rubber member.

Further, the rubber bag 31 is provided with a pressure control system 50. The pressure control system 50 includes a controller 51, a fluid source 52, a sensor (not shown), a filling valve 53 and a discharging valve 54. The filling valve 53 and the discharging valve 54 are each connected to the rubber bag 31 via pipelines. An outlet of the fluid source 52 is connected to the filling valve 53 via pipelines. The sensor is installed inside the rubber bag 31 for detecting a pressure of the rubber bag 31. The controller 51 is electrically connected to the fluid source 52, the sensor, the filling valve 53 and the discharging valve 54 respectively. The sensor is configured to detect the pressure of the rubber bag 31 and send the pressure to the controller 51. After the controller 51 receives a pressure signal and other control signals, the controller 51 controls the fluid source 52, the filling valve 53 and the discharging valve 54 to open or close by calculating, thus the fluid source 52 fills fluid into the rubber bag 31 via the filling valve 53, or the rubber bag 31 discharges the fluid via the discharging valve 54, thereby achieving a set pressure of the rubber bag 31. In this embodiment, the fluid source 52 is an air supply unit, and in addition to this, the fluid source 52 may be an oil supply unit. The air supply unit 52 is preferably an air compression pump. The discharging valve 54 has one end connected to the rubber bag 31, and another end directly in communication with air, so as to discharge gas into air. Both of the filling valve 53 and the discharging valve 54 are electromagnetic valves. The controller 51 according to the present application adopts a programmable logic controller (PLC) or other single-chip microcomputer controller, and the controller 51 is a conventional control chip, which is not described in further detail herein.

Further, a pressure reducing valve 55 is provided between the fluid source 52 and the filling valve 53, the air compressed by an air compressor passes through the pressure reducing valve 55, flows to the filling valve, and is filled into the rubber bag 31 when the filling valve 53 is in the opened state.

Further, the controller 51 is connected to a main control system of the rail vehicle, in order to receive traction/break signals, and/or frame acceleration signals of the rail vehicle. In operation of the rail vehicle, control signals from the main control system are all sent to the controller 51. The controller 51 performs calculation in conjunction with the control signals and pressure signals detected by the sensor, and controls the fluid source 52, the filling valve 53 and the discharging valve 54 to open or close.

The pressure control system according to the present application controls the pressure of the rubber bag at any time, thus further improving the comfort performance of the rail vehicle, and allowing the traction device according to the present application to be adapted to rail vehicles of various types.

Embodiment 2

This embodiment is substantially the same as Embodiment 1, except for a difference that: the rail vehicle bogie traction device in this embodiment further includes a center pin seat rotatably sleeved on the center pin; and two traction rubber bag assemblies are connected to the center pin seat respectively and are arranged in a Z shape. After mounting, the two traction rubber bag assemblies 30 are located in the same horizontal plane.

The rail vehicle bogie traction device is located between the frame 40 and the center pin 20 mounted (in a longitudinal direction) on a lower surface of the vehicle body chassis bolster 10, that is, the center pin 20 is fixed on the lower surface of the vehicle body chassis bolster 10 by a bolt assembly. The two traction rubber bag assemblies 30 are respectively connected to a front end and a rear end of the frame 40. A longitudinal stiffness of the rubber bag 31 may be obtained by setting filling and discharging of the pressure control system 50. Before mounting, the rubber bag 31 is in a pressure-free state, and the center pin 20 is mounted. After the center pin 20 is in place, compressed air from the fluid source 50 is decompressed by the pressure reducing valve 55, and is filled into the rubber bag 31 via the filling valve 53 in an opened state until the rubber bag 31 expands to be in contact with the center pin 20, and then is maintained at a set pressure. When it is required to disassemble, the filling valve 53 is closed, and the discharging valve 54 is opened, so that the compressed air in the rubber bag 31 is quickly discharged, and the center pin 20 is disassembled after the rubber bag 31 contracts.

Figure 4:
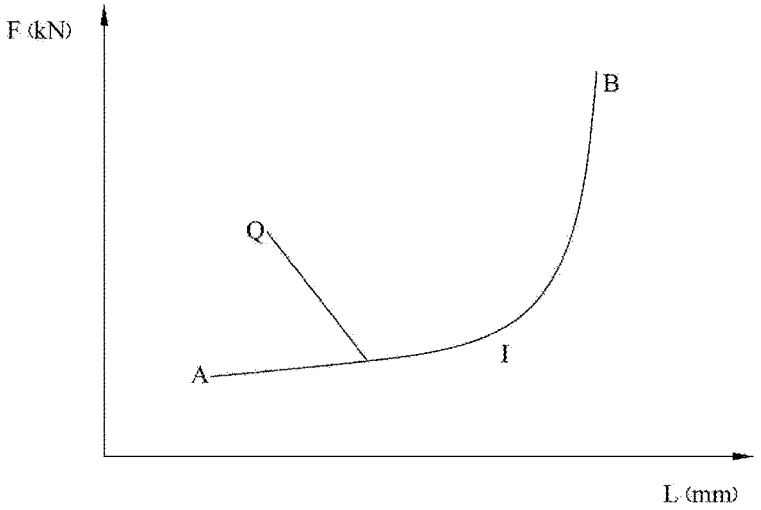
FIG. 4 shows a stiffness curve of the traction rubber bag assembly of the rail vehicle bogie traction device according to the embodiment of the present application.

In use, the rail vehicle bogie traction device according to the present application is mounted between the frame 40 and the vehicle body chassis bolster 10 in a manner shown in FIG. 1. As shown in FIG. 4, Q represents a stiffness characteristic curve. When the rail vehicle travels at a constant speed, the longitudinal stiffness of the rubber bag 31 is indicated by a segment "AI" in the stiffness characteristic curve Q shown in FIG. 4, a small-amplitude displacement and a high-frequency vibration of the frame 40 can be effectively isolated, thereby effectively restraining transmission of the longitudinal vibration to the center pin 20 and the vehicle body 10. In a traction working condition or a brake working condition, a large displacement of the center pin 20 relative to the frame 40 is generated, as shown in FIGS. 2 and 3, and one of, the traction rubber bag assemblies 30 located at the front side and the rear side of the center pin 20, is in a compressed state. Taking the case that the rail vehicle is in the brake working condition as an example, a brake force is transmitted from the frame 40 through wheels to the vehicle body chassis bolster 10, in such a case, the traction rubber bag assembly 30 mounted at the front side of the center pin 20 is compressed and the rubber bag 31 thereof is extruded, thus the rubber bag 31 is compressed and the pressure in the rubber bag 31 is increased, thereby improving the longitudinal stiffness, that is, the stiffness characteristic curve Q is in the segment "TB" as shown in FIG. 4. The traction rubber bag assembly 31 mounted at the rear side of the center pin 20 is stretched, and the pressure in the rubber bag 31 is reduced. In the traction device according to the present application, the traction rubber stack 32 has a low shear stiffness, so that when the vehicle vertically or horizontally moves relative to the bogie frame, the traction rubber bag assembly has a good mobility due to the traction rubber stack having the low shear stiffness.

The traction device according to the present application is formed by connecting the traction rubber stack and the rubber bag, and the longitudinal force between the vehicle body chassis bolster and the frame has nonlinear characteristics, which may effectively transmit a longitudinal load, and may also avoid the high-frequency vibration from transmitting to the vehicle body chassis bolster and the vehicle body via the traction device, thus improving the ride comfort. The traction device according to the present application has a simple structure, needs a small longitudinal mounting space, and adopts the traction rubber stack, thus, damages can be avoided.

The above descriptions are only preferred embodiments of the present application, and are not deemed to limit the present application. For those skilled in the art, the present application may have various modifications and variations. Any modifications, equivalent replacements and improvements made within the spirit and principle of the present application should fall into the scope of the present application.

What is claimed is:

1. A rail vehicle bogie traction device, comprising a center pin, and two traction rubber bag assemblies, wherein each of the traction rubber bag assemblies comprises a traction rubber stack and a rubber bag, the rubber bag is filled with fluid, and a pressure of the rubber bag is settable;

the traction rubber stack is connected to the rubber bag;

the center pin is fixed on a lower surface of a vehicle body chassis bolster; and each of the two traction rubber bag assemblies has one end connected to the center pin, and another end connected to a cross beam of a rail vehicle frame.

2. The rail vehicle bogie traction device according to claim 1, wherein the two traction rubber bag assemblies are symmetrically arranged with respect to a center of the center pin.

3. The rail vehicle bogie traction device according to claim 2, wherein the rubber bag is provided with a pressure control system, the pressure control system comprises a controller, a fluid source, a sensor, a filling valve and a discharging valve, and each of the filling valve and the discharging valve is connected to the rubber bag;

the fluid source is connected to the filling valve;

the sensor is mounted in the rubber bag for detecting a pressure in the rubber bag; and the controller is electrically connected to the fluid source, the sensor, the filling valve and the discharging valve.

4. The rail vehicle bogie traction device according to claim 2, wherein the two traction rubber bag assemblies are fixedly connected to a front side and a rear side of the center pin respectively.

5. The rail vehicle bogie traction device according to claim 4, wherein the rubber bag is provided with a pressure control system, the pressure control system comprises a controller, a fluid source, a sensor, a filling valve and a discharging valve, and each of the filling valve and the discharging valve is connected to the rubber bag;

the fluid source is connected to the filling valve;

the sensor is mounted in the rubber bag for detecting a pressure in the rubber bag; and the controller is electrically connected to the fluid source, the sensor, the filling valve and the discharging valve.

6. The rail vehicle bogie traction device according to claim 2, further comprising a center pin seat sleeved on the center pin, wherein the two traction rubber bag assemblies are respectively connected to the center pin seat and are arranged in a Z shape.

7. The rail vehicle bogie traction device according to claim 6, wherein the rubber bag is provided with a pressure control system, the pressure control system comprises a controller, a fluid source, a sensor, a filling valve and a discharging valve, and each of the filling valve and the discharging valve is connected to the rubber bag;

the fluid source is connected to the filling valve;

the sensor is mounted in the rubber bag for detecting a pressure in the rubber bag; and the controller is electrically connected to the fluid source, the sensor, the filling valve and the discharging valve.

8. The rail vehicle bogie traction device according to claim 1, wherein the number of the traction rubber stack is two, the number of the rubber bag is one, and the two traction rubber stacks are respectively connected to two sides of the rubber bag and are coaxially arranged.

9. The rail vehicle bogie traction device according to claim 8, wherein the rubber bag is provided with a pressure control system, the pressure control system comprises a controller, a fluid source, a sensor, a filling valve and a discharging valve, and each of the filling valve and the discharging valve is connected to the rubber bag;

the fluid source is connected to the filling valve;

the sensor is mounted in the rubber bag for detecting a pressure in the rubber bag; and the controller is electrically connected to the fluid source, the sensor, the filling valve and the discharging valve.

10. The rail vehicle bogie traction device according to claim 1, wherein a compression elastic member is provided in the rubber bag, the compression elastic member has one end fixed to an inner surface, at one side close to the center pin, of the rubber bag, and an axis of the compression elastic member has the same direction as an axis of the traction rubber stack.

11. The rail vehicle bogie traction device according to claim 10, wherein the rubber bag is provided with a pressure control system, the pressure control system comprises a controller, a fluid source, a sensor, a filling valve and a discharging valve, and each of the filling valve and the discharging valve is connected to the rubber bag;

the fluid source is connected to the filling valve;

the sensor is mounted in the rubber bag for detecting a pressure in the rubber bag; and the controller is electrically connected to the fluid source, the sensor, the filling valve and the discharging valve.

12. The rail vehicle bogie traction device according to claim 1, wherein the rubber bag is provided with a pressure control system, the pressure control system comprises a controller, a fluid source, a sensor, a filling valve and a discharging valve, and each of the filling valve and the discharging valve is connected to the rubber bag;

the fluid source is connected to the filling valve;

the sensor is mounted in the rubber bag for detecting a pressure in the rubber bag; and the controller is electrically connected to the fluid source, the sensor, the filling valve and the discharging valve.

13. The rail vehicle bogie traction device according to claim 12, wherein a pressure reducing valve is provided between the fluid source and the filling valve.

14. The rail vehicle bogie traction device according to claim 12, wherein the fluid source is an air supply unit or an oil supply unit.

15. The rail vehicle bogie traction device according to claim 1, wherein the controller is connected to a main control system of a rail vehicle for receiving traction/brake signals and/or frame acceleration signals of the rail vehicle.

* * * * *